US005078621A

United States Patent [19]

Nishikawa et al.

[11] Patent Number: 5,078,621

[45] Date of Patent: Jan. 7, 1992

[54] CONNECTOR

[75] Inventors: Toshio Nishikawa; Yuichi Maruyama; Tomoyoshi Onishi, all of Nagaokakyo, Japan

[73] Assignee: Murata Manufacturing Co., Ltd., Nagaokakyo, Japan

[21] Appl. No.: 582,614

[22] Filed: Sep. 14, 1990

[30] Foreign Application Priority Data

Sep. 25, 1989 [JP] Japan ..... 1-112618[U]
Sep. 25, 1989 [JP] Japan ..... 1-112619[U]
Oct. 25, 1989 [JP] Japan ..... 1-124649[U]

[51] Int. Cl.[5] ..... H01R 13/00
[52] U.S. Cl. ..... 439/581
[58] Field of Search ..... 439/63, 578-585

[56] References Cited

U.S. PATENT DOCUMENTS 3,601,776 8/1971 Curl ..... 439/581
4,453,796 6/1984 Monroe ..... 439/581
4,603,926 8/1986 Nesbit et al. ..... 439/581
4,795,352 1/1989 Capp et al. ..... 439/581

*Primary Examiner*—Joseph H. McGlynn
*Attorney, Agent, or Firm*—Wenderoth, Lind & Ponack

[57] ABSTRACT

A plug side connector for substrate mounting, which includes a case formed with a recess, an inner contact provided in the recess so as to be joined with a corresponding inner contact socket of a mating jack side connector, and a partially cylindrical connector outer conductor provided at part of an inner periphery of the recess so as to be joined with an outer conductor of the mating jack side connector.

9 Claims, 7 Drawing Sheets

CONNECTOR

BACKGROUND OF THE INVENTION

The present invention generally relates to an electrical connector and more particularly, to a surface mounting type connector to be used for connecting various electrical parts or the like onto a circuit board.

Conventionally, as a surface mounting type connector, there has been employed, for example, a connector A having a construction as shown in FIGS. 12 to 15, and arranged to be coupled with a mating connector B provided with a housing 83, and a socket 82 connected to an inner conductor 81, etc. as illustrated in FIG. 16. The connector A includes a case 61 formed with a recess 61*a* and an inner contact 62 fitted into the socket 82 of the connector B and a connector outer conductor 63 provided in said recess 61*a*, with an inner contact terminal 64 connected with said inner contact 62, and an outer conductor terminal 65 connected with the connector outer conductor 63 being led out from a fixing surface 66 provided at a bottom wall of the case 61 so as to confront a circuit substrate 67 (FIGS. 14 and 15). Thus, as shown in FIG. 12, by soldering the inner contact terminal 64 and the outer conductor terminal 65, respectively onto a microstrip line M and a grounding pattern G provided on the circuit substrate 67, the connector A is actually mounted on said substrate 67 through electrical and mechanical connection therewith. In FIGS. 12, 14 and 15, the solder protruding from the soldering surfaces 70 between the connector A and the substrate 67 is indicated at Numeral 70*a*.

In the conventional arrangement as described so far, although the connector A is connected and fixed on the circuit substrate 67 at the soldering surfaces 70, since the soldering area is small, and moreover, the connector A is soldered only at two portions, i.e. at the inner contact terminal 64 and the outer conductor terminal 65 (FIG. 12), the fixing surface 66 of the case 61 is raised or floating without contacting the circuit substrate 67 at opposite sides of a line P connecting the inner contact terminal 64 and the outer conductor terminal 65, and therefore, if a prying force in a direction indicated by an arrow X or Y (FIG. 14) is applied during connection with or removal from the mating connector B, there is a possibility that the connector A is undesirably separated from the circuit substrate 67, while a sufficient reliability can not be achieved with respect to the electrical connection thereof.

Furthermore, there is also involved a problem that the connector A tends to be soldered onto the circuit substrate 67 in an inclined state as shown in FIG. 15, due to difficulty in mounting it on said substrate in a proper attitude.

SUMMARY OF THE INVENTION

Accordingly, an essential object of the present invention is to provide a connector which has a sufficient connecting strength with respect to a substrate, and can be readily fixed onto the substrate in a proper posture without undesirable inclination, etc. during actual mounting.

Another object of the present invention is to provide a connector of the above described type and a connecting arrangement for the connector, in which the height of the connector may be reduced, with sufficiently strong mechanical and electrical connections, while undesirable increase of reflection due to faulty impedance matching is not easily produced.

A further object of the present invention is to provide a coaxial connector of a chip type, in which the characteristic impedance is adapted to be constant over the entire unit through reduction of portions with mismatching.

In accomplishing these and other objects, according to one aspect of the present invention, there is provided a plug side connector for substrate mounting, which includes a case formed with a recess, an inner contact provided in said recess so as to be joined with a corresponding inner contact socket of a mating jack connector to be connected therewith, and a partially cylindrical connector outer conductor provided at part of an inner periphery of said recess so as to be joined with an outer conductor of said mating jack connector.

In another aspect of the present invention, there is provided a jack connector for cable mounting, which includes a housing provided with a cylindrical connection portion with slits so as to be joined with a connector outer conductor of a mating plug connector for connection, and an inner contact socket held in said housing in an insulated manner so as to be joined with an inner contact of said mating plug connector to be connected therewith.

In a further aspect of the present invention, there is also provided a connecting arrangement between one connector and the other mating connector, which comprises one connector, which includes a case formed with a recess, an inner contact provided in said recess so as to be joined with a corresponding inner contact socket of a mating connector to be connected therewith, and a connector outer conductor provided at part of an inner periphery of said recess formed in said case, and having a partially cylindrical shape corresponding to a shape of a cylindrical connecting portion of a housing of the other mating connector to be connected therewith, and said the other mating connector which includes the housing as an outer conductor with the connecting portion of the cylindrical shape corresponding to the partially cylindrical shape of said connector outer conductor and having slits so as to be connected with the connecting portion of said connector outer conductor of said one connector and an inner contact socket held in said housing in an insulated manner so as to be joined with the inner contact of said mating connector to be connected therewith.

Accordingly, in the plug connector according to the present invention as described above, the inner contact provided in the recess formed in the case is joined with the corresponding inner contact socket of the mating jack connector to be connected therewith, while the partially cylindrical connector outer conductor provided at part of the inner periphery of the recess provides a sufficient joining with the outer conductor of the mating jack connector.

Meanwhile, in the jack side connector of the present invention, the cylindrical connection portion with the slits of the housing is sufficiently strongly joined with the connector outer conductor of the mating plug side connector for connection, and the inner contact socket held in the housing in the insulated manner is joined with the inner contact of the mating plug connector.

In the connector connecting arrangement of the present invention, the connector outer conductor having the shape corresponding to the shape of the outer periphery of the connecting portion of the housing for the mating connector is joined with the connecting portion of the housing formed with the slits and having a required resiliency, while the inner contact is coupled with the inner contact socket of the mating connector. Consequently, the connecting portion of the housing provides a sufficiently strong joining with the outer conductor over a large area, thereby to prevent concentration of electric current, and to improve the retaining force in the mechanical connection therebetween.

In a still further aspect of the present invention, there is also provided a connector which comprises a connector which has a case having a fixing surface for fixing thereof onto a substrate, and an inner contact terminal led out from an inner contact for connection with a line of said substrate, an outer conductor terminal led out from a connector outer conductor also for connection with the line of said substrate, and at least two fixing terminals for mechanically connecting and fixing the connector and said substrate. The terminals are provided on said fixing surface, and the fixing surface is divided into a first quadrant, a second quadrant, a third quadrant and a fourth quadrant with respect to an origin point at its central portion for representing fixing positions thereon, with the terminals being disposed so that at least one substantial portion of each of said terminals is positioned in each of the four areas defined by said first, second third and fourth quadrants.

In a still further aspect of the present invention, there is further provided a coaxial connector which includes a central conductor and an outer conductor disposed in an insulated state around said central conductor, and a plate-like connecting piece having said central conductor extending upwardly from a forward end portion of said connecting piece. The connecting piece has a circular shape at the forward end portion thereof, and a belt-like shape at a base end portion thereof, with part of the circular shape at the forward end portion farthest from the base end portion side being cut off in an arcuate shape. The arcuate portion has its cut off chord length to be equal to a width of the belt-like portion in the vicinity of said circular portion.

By the above arrangement of the present invention, since the part of the circular shape at the forward end portion of the connecting piece is cut off in the arcuate shape, and the arcuate portion has its cut off chord length to be equal to the width of the belt-like portion in the vicinity of the circular portion, the connecting piece may be equivalently regarded as a belt-like member defined in its width from the forward end to the base portion, with the arcuate protrusions provided at the opposite sides thereof. The protrusions may be embedded in resin in a similar manner as in the conventional practice so as to be utilized for fixing of the forward end portion. Therefore, when the protrusions are fixed in the mold resin, even if coupling with or disengagement from the coaxial connector at the jack side is repeatedly effected, matching may be achieved over the entire unit in a state where falling off is prevented.

BRIEF DESCRIPTION OF THE DRAWINGS

These and other objects and features of the present invention will become apparent from the following description of the preferred embodiment thereof with reference to he accompanying drawings, in which.

DETAILED DESCRIPTION OF THE INVENTION

Figure 1:
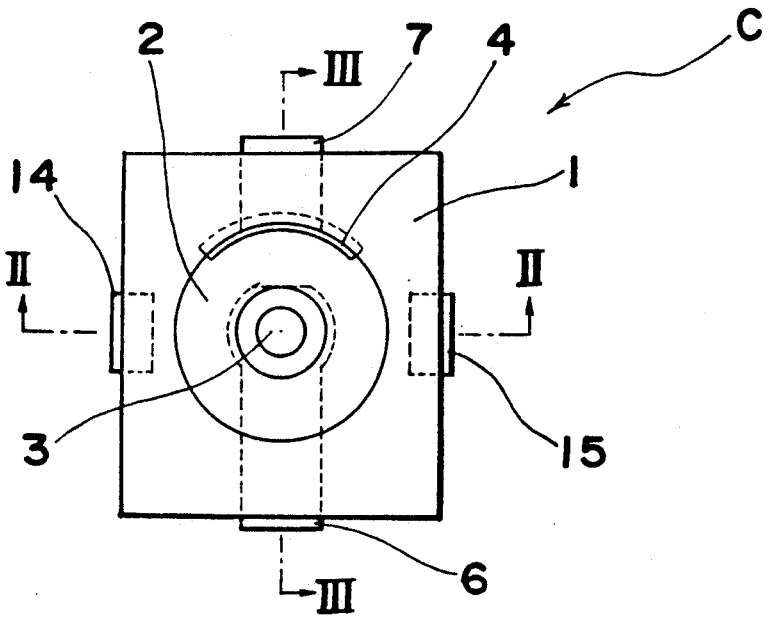
FIG. 1 is a top plan view of a plug connector C according to one preferred embodiment of the present invention.

Before the description of the present invention proceeds, it is to be noted that like parts are designated by like reference numerals throughout the accompanying drawings.

Figure 2:
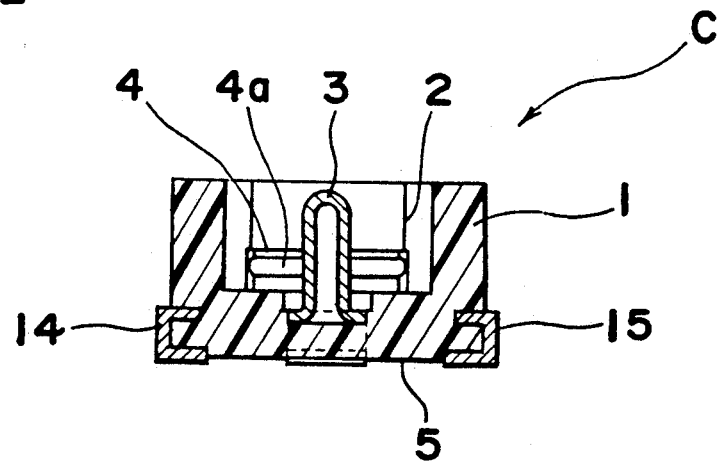
FIG. 2 is a cross section taken along the line II—II in FIG. 1.
Figure 3:
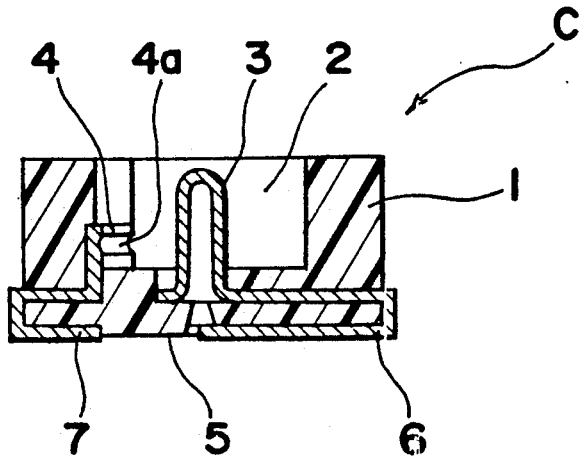
FIG. 3 is a cross section taken along the line III—III in FIG. 1.
Figure 4:
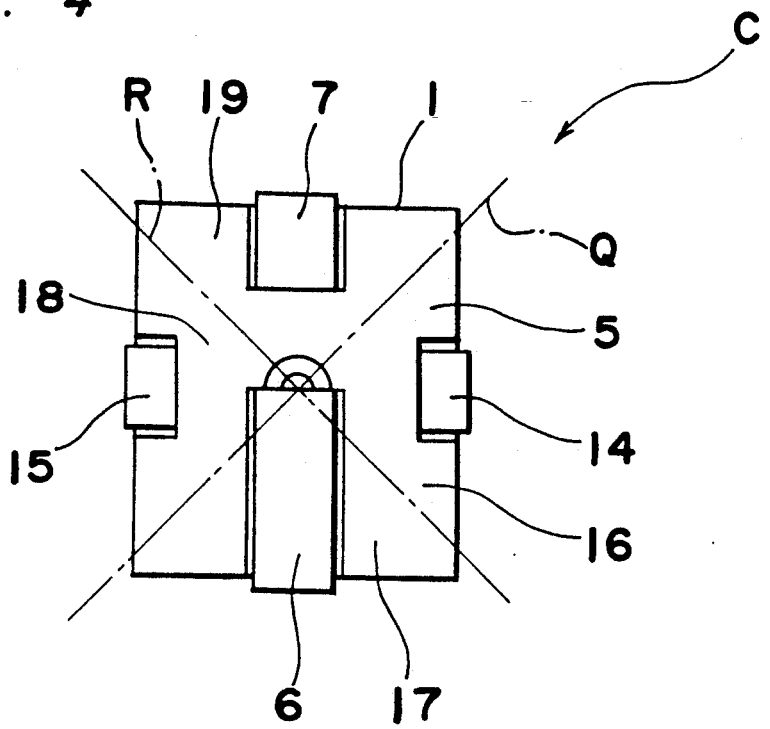
FIG. 4 is a bottom plan view of the plug side connector C of FIG. 1.

Referring now to the drawings, there is shown in FIGS. 1 to 3, a plug side connector C to be mounted on a circuit substrate or the like, which includes a case 1 having formed therein a recess 2, an inner contact 3 of a circular columnar shape provided at a central portion of the recess 2, and a partially cylindrical or arcuate connector outer conductor 4 formed by curving a flat plate-like conductor and provided at part of an inner periphery of said recess 2. Adjacent to the upper edge of the connector outer conductor 4, another recess or groove 4*a* is formed in a circumferential direction thereof. Onto a bottom face 5 of the case 1 forming a fixing surface confronting a substrate D (FIG. 5), an inner contact terminal 6 connected with the inner contact 3 and an outer conductor terminal 7 connected with the connector outer conductor 4 are led out. Furthermore, as is most clearly shown in FIG. 4, there are also formed two fixing terminals 14 and 15 on the fixing surface 5 of the case 1. In the above arrangement, the inner contact terminal 6, the outer conductor terminal 7, and the at least two fixing terminals 14 and 15 are respectively disposed so that substantial portions thereof are positioned in regions divided into a first quadrant 16, a second quadrant 17, a third quadrant 18 and a fourth quadrant 19 by lines Q and R, with a central portion of the fixing surface 5 set as an origin point.

Figure 5:
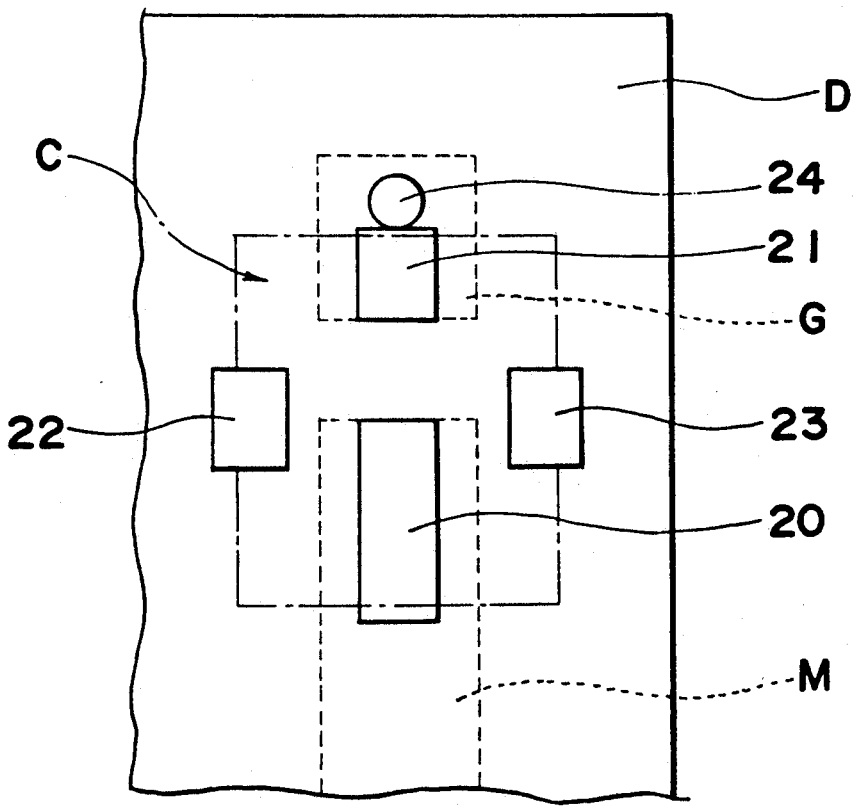
FIG. 5 is a top plan view of a substrate for mounting the connector C of FIG. 1.

On the substrate D for mounting the above connector C thereon, there are formed, as shown in FIG. 5, land portions 20 and 21 for soldering a microstrip line M, a grounding pattern G, the inner contact terminal 6 and the outer conductor terminal 7, and similar land portions 22 and 23 for soldering the fixing terminals 14 and 15, and also, a through-hole 24.

Thus, by soldering the inner contact terminal 6 onto the land portion 20 on the microstrip line M, the outer conductor terminal 7 onto the land portion 21 on the grounding pattern G, and the fixing terminals 14 and 15 respectively onto the soldering land portions 22 and 23, the plug connector C is actually mounted on the substrate D.

The connector C thus mounted is stable, since the inner contact terminal 6, outer conductor terminal 7 and the fixing terminals 14 and 15 are disposed so that the substantial portions thereof are respectively located in each of the four regions defined by the first to fourth quadrants of the fixing surface, and is sufficiently strong even against a prying force applied thereto, thereby providing a positive connection both mechanically and electrically.

It should be noted here that in the foregoing embodiment, although the connector C has been described as provided with two fixing terminals 14 and 15, the number of such fixing terminals may be further increased depending on necessity.

It should also be noted here that in the foregoing embodiment, the substantial portion of at least one terminal has only to be disposed in each of the quadrants, and the kinds of the terminals to be disposed in the respective quadrants are not limited, while one terminal may be disposed to bridge the respective quadrants.

As is seen from the above description, in the connector C according to the foregoing embodiment, since the terminals are so disposed that a substantial portion of at least one terminal is located in each of the four regions defined by the first, second, third and fourth quadrants, thereby to connect the respective terminal onto the substrate for fixing, the area of the soldering portion is enlarged for improved bonding strength, while owing to the fact that the fixing terminals are properly positioned, the connector may be mounted on the substrate in a proper attitude, and thus, a strong connection which can fully cope with even a stress tending to pry off the connector, may be achieved.

Figure 6:
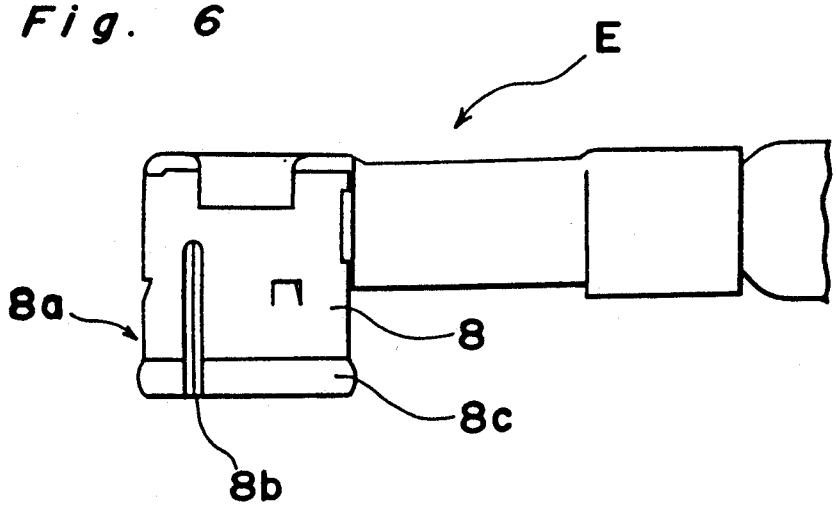
FIG. 6 is a side elevational view of a jack side connector E which is to be coupled with the connector described with reference to FIGS. 1 to 5.
Figure 7:
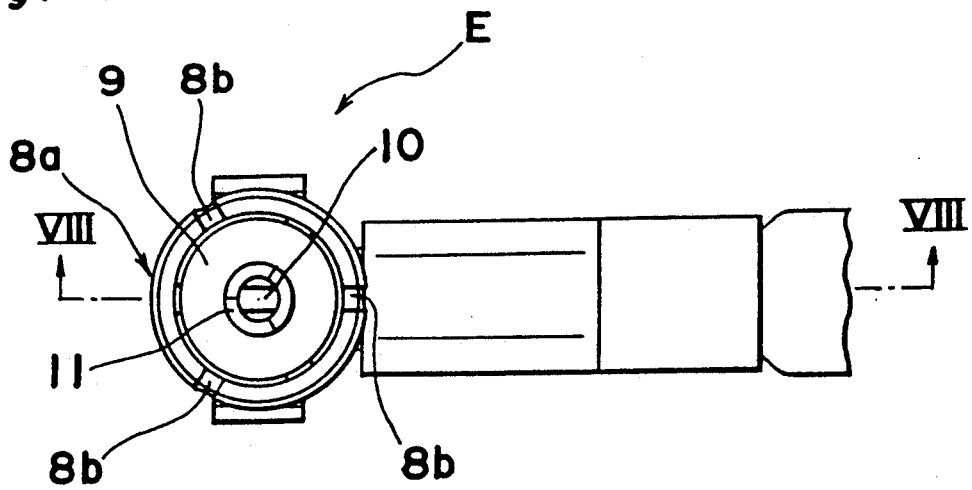
FIG. 7 is a top plan view of the jack side connector E of FIG. 6.
Figure 8:
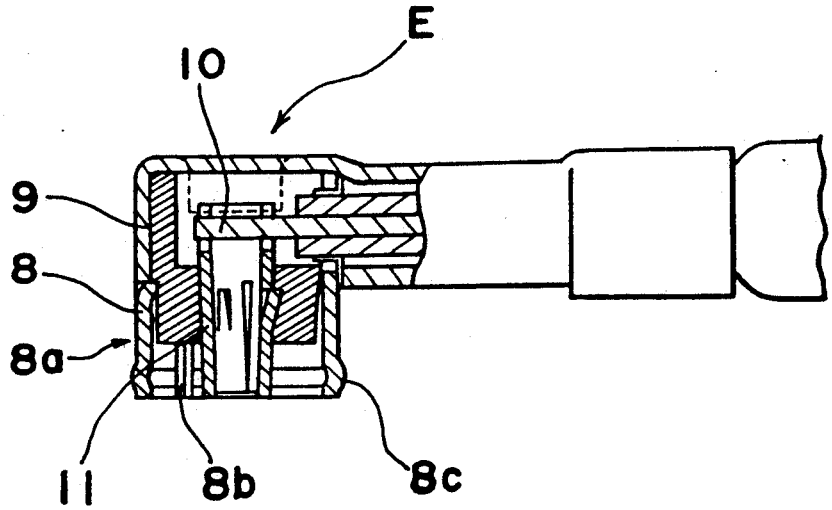
FIG. 8 is a partial cross sectional view of the jack connector E of FIG. 6 taken along the line VIII—VIII in FIG. 7.

Reference is also made to FIGS. 6 to 8 related to an application of the first embodiment as described so far. In FIGS. 6 to 8, there is shown a jack side connector E as a mating connector to be connected with the plug side connector C described so far.

As shown in FIG. 8, the jack connector E includes a housing 8 as an outer conductor provided with a cylindrical connecting portion 8*a* for connection with the plug side connector C, and a three-split type center socket 11 as an inner contact connected with an inner conductor 10, and held in an insulated state by an insulating material 9 within the connecting portion 8*a*. The above connecting portion 8*a* is formed with three slits 8*b* extending generally in a parallel relation in an axial direction at peripheral intervals of 120° so as to provide proper resiliency, while an annular protrusion 8*c* to be engaged with the groove 4*a* formed in the connector outer conductor 4 of the plug side connector C referred to earlier is formed adjacent to the forward edge of said connecting portion 8*a*. Moreover, the connecting portion 8*a* of the housing 8 is hardened to provide elasticity required for achieving sufficiently strong connection with the connector outer conductor 4.

A description will be given of connection between the plug side connector C and the jack connector E.

Upon insertion of the connecting portion 8*a* of the jack connector E into the recess 2 of the plug connector C, the annular protrusion 8*c* formed adjacent to the forward edge of the cylindrical connecting portion 8*a* of the jack connector E is brought into engagement with the corresponding recess or the groove 4*a* of the partially cylindrical connector outer conductor 4 of the plug connector C. The protrusion 8*c* of the connecting portion 8*a* formed with the slits 8*b* is thus pressed against the inner wall of the groove 4*a* by the resiliency thereof for positive connection therebetween. Meanwhile, the inner contact 3 of the plug connector C is fitted into the three-split center socket 11 of the jack connector E, and the center socket 11 of the connector E fixedly grasps the inner contact 3 of the connector C for coupling therebetween.

Thus, positive electrical and mechanical connection between the plug side connector C and the mating jack connector E may be achieved by a simple construction.

In the foregoing embodiment, although hardening of the connecting portion 8*a* of the housing 8 is carried out for imparting thereto resiliency necessary for achieving positive connection with respect to the connector outer conductor 4, such hardening may be dispensed with if a proper material having the necessary resiliency is selected to constitute the housing.

It should also be noted that, in the foregoing embodiments, although the connector and the connecting construction thereof in which the inner conductor has a simple core are described, the present invention may also be applied to connectors and connecting construction thereof in which the inner conductors are multicores.

As is seen from the foregoing description, in the connectors and connecting construction thereof according to the present invention, the plug connector makes it possible to achieve positive connection in the case where the outer conductor of the mating connector has a cylindrical configuration, and moreover, since it is not intended to hold the housing by the resiliency of the connector outer conductor, the connector outer conductor may have a reduced height for compact size. Furthermore, since the connector outer conductor is not required to have elasticity, it becomes possible to place the connector in a reflow furnace for improved workability.

On the other hand, the jack connector has a sufficient resiliency at the connecting portion of the housing, and thus, has an improved holding force for holding the mating connector.

The connector connecting construction of the present invention is advantageous in that, since the contact area between the connector outer conductor and the mating connector is increased, concentration of electric current is avoided for reduction of VSWR (voltage standing wave ratio). Additionally, since sufficiently strong mechanical and electrical connection can be achieved, even when a prying force is applied to the mating connector, there is no possibility that electrical discontinuity will take place due to breakage of the electrical connection, etc.

Referring further to FIGS. 9(A) to 11, coaxial connectors according to a second embodiment of the present invention will be described hereinafter.

Figure 9A:
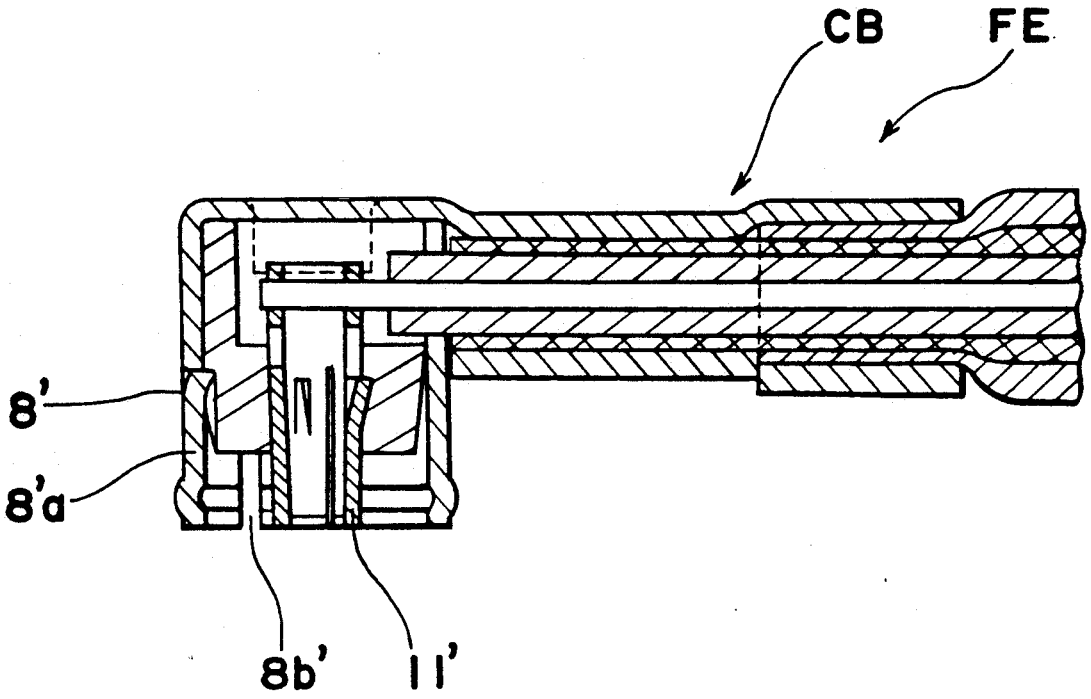
FIG. 9(A) is a cross sectional view of a jack coaxial connector FE according to a second embodiment of the present invention.

In FIG. 9(A), the jack coaxial connector FE has a construction generally similar to that of the connector E of FIGS. 6, 7 and 8, and includes a housing 8, having an outer conductor 8*a'* formed with split grooves 8*b'* and a socket-like central conductor 11', with a coaxial cable CB being connected thereto as shown.

Figure 9B:
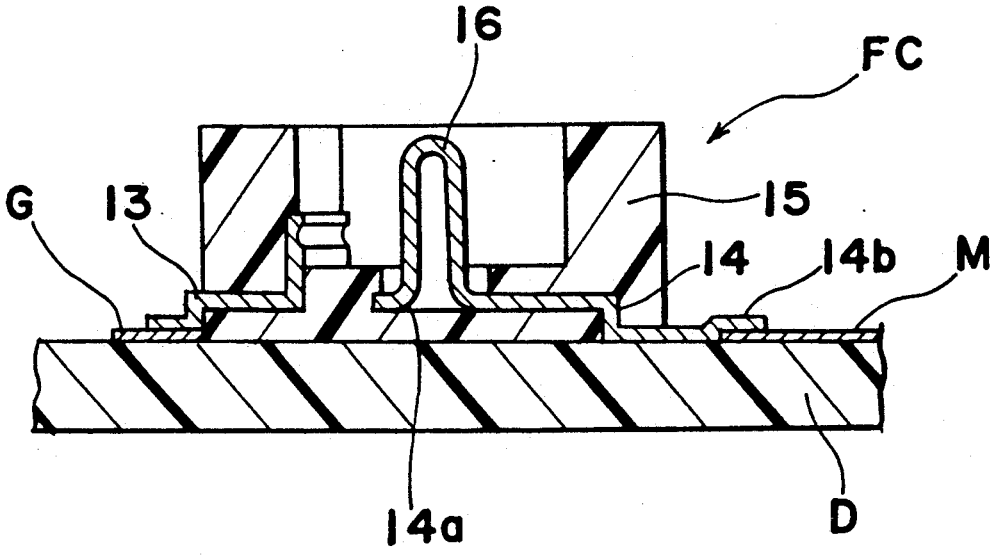
FIG. 9(B) is a fragmentary cross sectional view of a plug connector FC to be connected with the jack connector FE of FIG. 9(A)

The plug side coaxial connector FC as shown in FIG. 9(B) includes a central conductor 16 and an outer conductor 13 disposed in an insulated state around the central conductor 16 so as to partially surround said central conductor 16, and a plate-like connecting piece 14 provided in a manner as described hereinbelow.

The connecting piece 14 has a forward end portion 14*a* in a circular shape provided with the central conductor 16 extending upwardly therefrom and a base end portion 14*b* connected thereto.

The central conductor 16 is formed to extend upwardly from the forward end portion 14*a* of the connecting piece 14, with part of the base end portion 14*b* and the outer conductor 13, and the central conductor 16 being exposed from a molded resin cases 15 as shown in FIG. 9(B). Fixing of such a coaxial plug connector FC onto the circuit board D is effected by soldering the under surface of the outer conductor 13 and the base end portion 14*b* of the connecting piece 14, respectively onto the grounding pattern G and the strip line M formed on the circuit board D.

Figure 10:
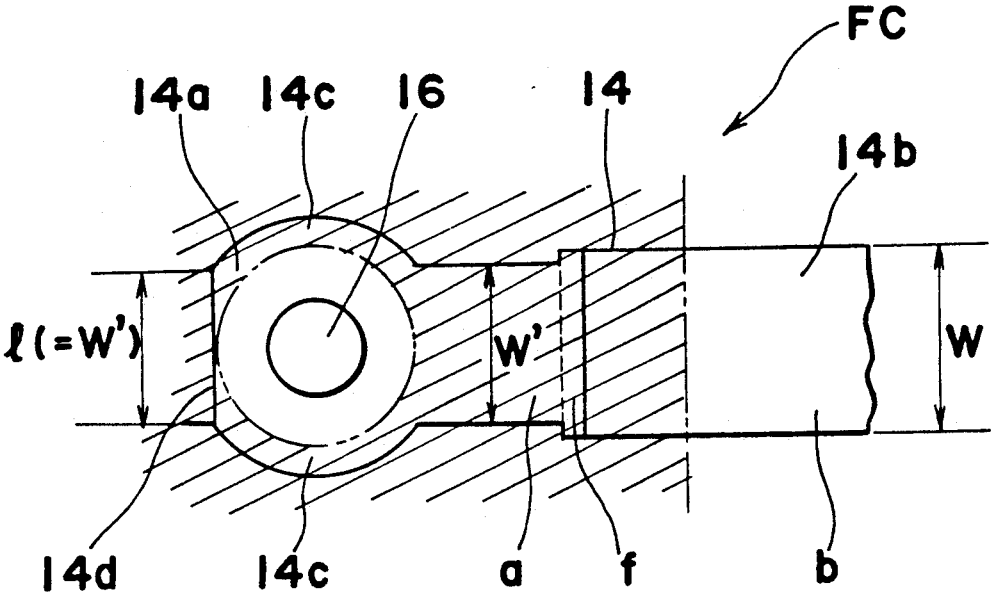
FIG. 10 is a fragmentary top plan view showing a connecting piece of the plug coaxial connector FC of FIG. 9(B)
Figure 11:
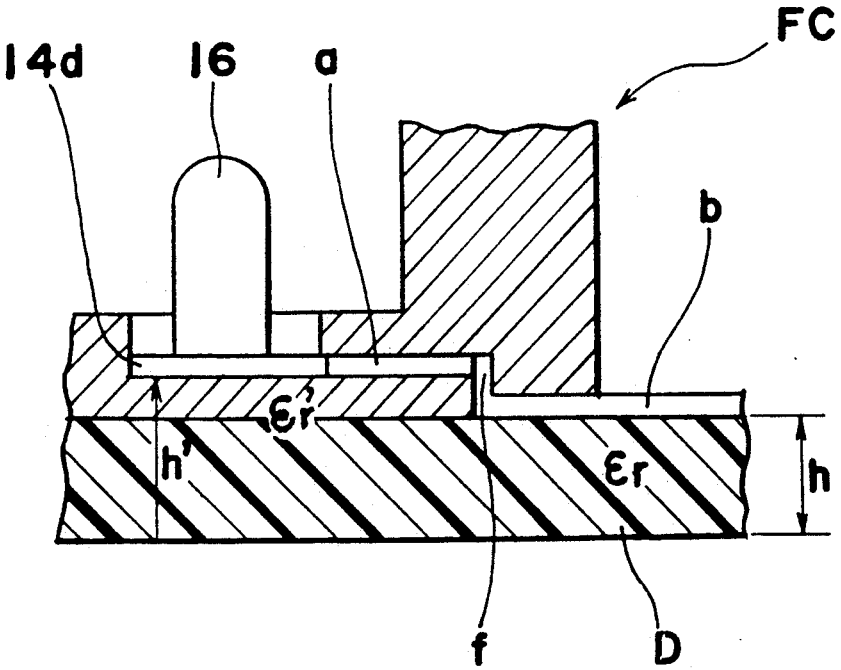
FIG. 11 is a fragmentary side elevational view of the portion shown in FIG. 10.
Figure 12:
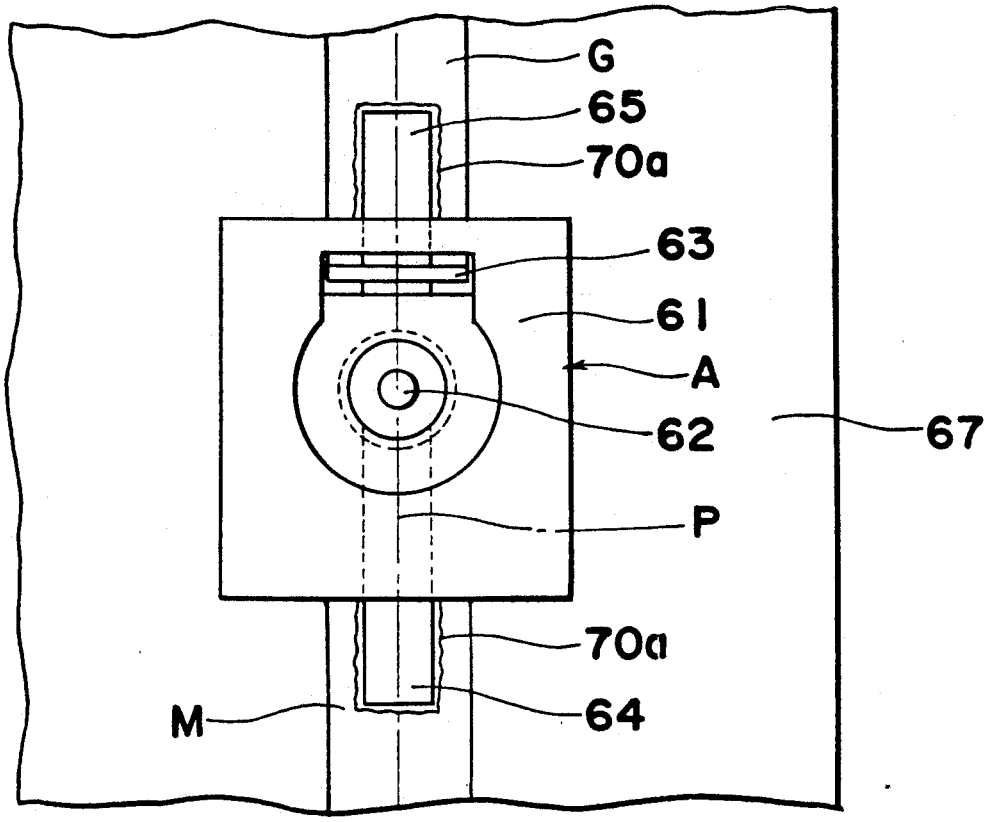
Fig. 12 PRIOR ART
FIG. 12 is a top plan view showing a conventional connector and a substrate (already referred to)
Figure 13:
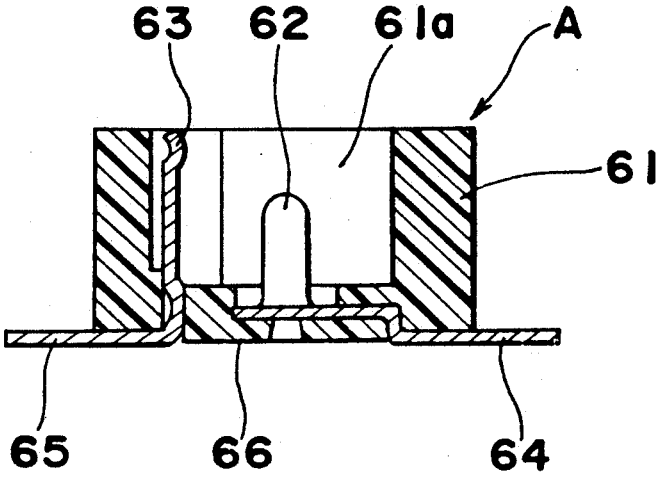
Fig. 13 PRIOR ART
FIG. 13 is a cross sectional view of the conventional connector shown in FIG. 12 (already referred to)
Figure 16:
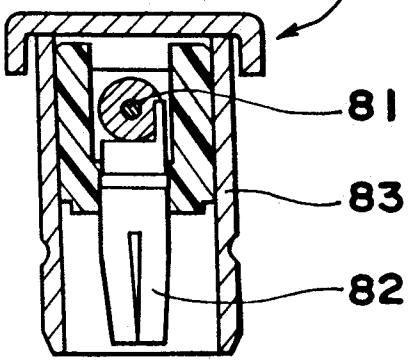
Fig. 16 PRIOR ART
FIG. 16 is a cross sectional view of a mating connector to which the conventional connector of FIG. 12 is connected (already referred to).
Figure 14:
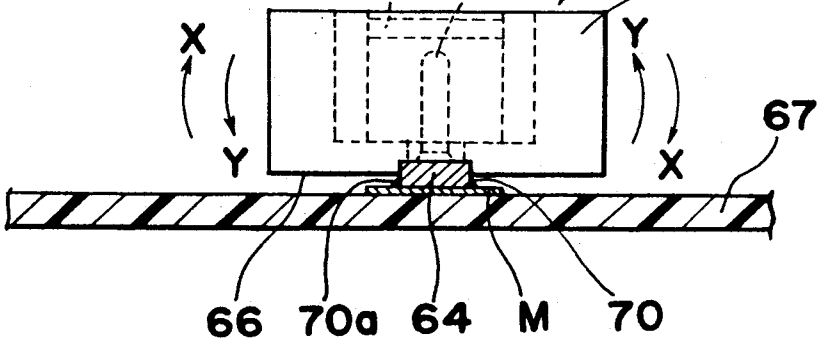
Fig. 14 PRIOR ART
FIG. 14 is a side elevational view, partly in section, showing the state where the conventional connector is mounted on the substrate in a proper state (already referred to)
Figure 15:
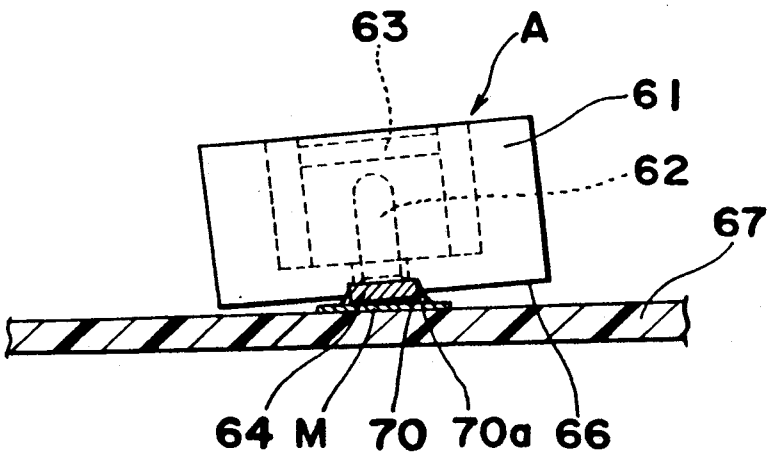
Fig. 15 PRIOR ART
FIG. 15 is a view similar to FIG. 14, which particularly shows the conventional connector in another state (already referred to)

As illustrated in FIGS. 10 and 11, the base end portion 14*b* is has a small width portion a at its end leading to the forward end portion 14*a*, and a large width portion b at the end opposite thereto, with a stepped or folded portion f being formed at the portion between said small width portion a and large width portion b so that said small width portion a is higher than said large width portion b (FIG. 11).

On the other hand, with respect to the forward end portion 14*a* set to be at the same height as the small width portion a, its side remote from the portion connected with the base end portion 14*b* is cut off in an arcuate shape to form a cut off portion 14*d* (FIG. 10).

The chord length l at the cut off portion 14*d*, and the width W of the large width portion b, the width W' of the small width portion a are so defined as to achieve matching over the entire connecting piece 14, and the dimensions for the widths W and W' are determined based on the height between the undersurface of the substrate D and the large width portion b or the small width portion a and dielectric constants therebetween, with the cut off chord length l being set to be equal to the width W' of the small width portion a.

Hereinafter, calculations with respect to the dimensions for the widths W and W' and the chord length l will be explained.

Firstly, the widths W and W' will be calculated. In the widths W and W', the width W is calculated, when a characteristic impedance Zo to be matched is determined, based on such impedance Zo, a height h from the undersurface of the circuit substrate D up to the large width portion b, and dielectric constant $\epsilon r$ for the portion with the height h, i.e. the substrate D, and equations (1) and (3) given below, while through employment of equations (2) and (3) instead of the equations (1) and (3), two sets of values are to be computed.

$$\epsilon eff=(\epsilon r+1)/2+(\epsilon r-1)[(1+12h/W)^{-0.5}\ 0.04(1-W/h)^2] \quad (1)$$

$$\epsilon eff=(\epsilon r+1)/2+(\epsilon r-1)[(1+12h/W)^{-0.5}]( \quad 2)$$

$$Zo=60 \log e\ [8h/W+W/(4h)]\div(\epsilon eff)^{0.5} \quad (3)$$

where $\epsilon eff$ represents effective dielectric constant.

Thus, with respect to the calculated values, it is checked whether the values which employ the equations (1) and (3) satisfy the relation $W/h \leqq 1$ or those which employ the equations (2) and (3) satisfy the relation $W/h > 1$, and the value which satisfy such relation is to be adopted. It is to be noted that the equation (1) is a formula to be employed for the relation $W/h \leqq 1$, while the equation (2) is a formula to be used for the relation $W/h > 1$.

The other width value W' is calculated in a similar manner by setting a height h' from the undersurface of the substrate D up to the small width portion a as the height h, and also, by using as the dielectric constant $\epsilon r$, a dielectric constant $\epsilon r$, in which the nature of a molding resin 15 present therebetween and made of a material different from that of the wiring substrate D of ceramics, alumina, etc. is taken into consideration, and then, the value l is set to be equal to the value W' thus obtained.

Since the connecting piece 14 is prepared so as to satisfy the dimensions W,W' and thus obtained, the portion ranging from the narrow portion a of the base end portion 14*b* to the forward end portion 14*a* may be regarded equivalently as the belt-like portion with a predetermined width defined by W' having protrusions 14*c* at opposite sides thereof (FIG. 10).

Although it is preferable to substantially eliminate the projections 14*c* for the purpose of matching, such protrusions 14*c* are required, since, if they are not formed, the forward end portion 14*a* can not be positively secured.

It should be noted that, in the foregoing embodiment, although the width of the base end portion 14*b* of the connecting piece 14 is varied along its length, the present invention is not limited in its application to such an arrangement alone, but may be similarly applied, for example, to a case where the base end portion 14*b* has a constant in width over its entire length, or where its width is altered in more than three levels at more than two places on the way.

As is clear from the foregoing description, according to the connector FC of the present invention, since the forward end portion of the connecting piece is formed into a circular shape cut in an arcuate shape at its one portion, with the cut off chord length at said cut off portion being made equal to the width of the portion connected with the forward end of the base end portion, the connecting piece may be regarded equivalently as an belt-like member restricted in its width and having the arcuate protrusions at its opposite sides, and when the protrusions are fixed in the mold, even if coupling or disengagement with respect to the jack coaxial connector is repeatedly effected, matching may be achieved on the whole in the state where falling off of said connector is advantageously prevented. Accordingly, for example, in the case where the connector of the present invention is mounted on a wiring substrate made of alumina, the VSWR (voltage standing wave ratio) may be kept below 1.2 at 1.09 during a signal of 2 GHz.

Although the present invention has been fully described by way of example with reference to the accompanying drawings, it is to be noted here that various changes and modifications will be apparent to those skilled in the art. Therefore, unless other wise such changes and modifications depart from the scope of the present invention, they should be construed as being included therein.

What is claimed is:

1. A plug connector for mounting on a substrate, comprising:

a casing having a top and a bottom and opposite ends and lateral sides extending between said ends, and a cylindrical recess extending into said housing from the top thereof and having an inner bottom;

an inner contact in said recess extending upwardly from the center of the inner bottom for engagement by a corresponding inner socket of a mating connector;

a conductor attached to the lower end of said inner contact and extending to and along the bottom of said casing to one end thereof;

a partially cylindrical outer contact on the wall of said recess and extending partly around the periphery of said recess for engagement by a corresponding outer conductor of a mating connector;

a further conductor attached to the lower end of said outer contact and extending to and along the bottom of said casing to the other end thereof; and a pair of fixing terminals on the bottom of said casing at the lateral sides thereof and electrically isolated from said conductors, whereby when the plug connector is mounted on a substrate, the conductors and the fixing terminals serve to support the plug connector stably on the surface of the substrate.

2. A plug connector as claimed in claim 1 in which said conductor attached to the lower end of said inner contact, said further conductor attached to the lower end of said outer contact, and said pair of fixing terminals all project slightly below the bottom of surface of the casing.

3. A plug connector as claimed in claim 1 in which the bottom of said casing is divided into four quadrants with the point corresponding to the position of said inner contact as the origin point of the quadrants, said fixing terminals and said conductors each being in a different quadrant.

4. An electrical connector structure as claimed in claim 1 in which said inner contact is cylindrical, and said conductor attached thereto being a flat conductor extending around the base thereof in an annular shape and having the part on one side of said inner contact cut along a chord, and having the part of the conductor extending within the material of the bottom of said casing extending from the opposite side of said inner contact from said chord and having a width equal to the length of the chord.

5. In combination, a plug connector and a substrate on which said plug connector is mounted;

said plug connector comprising:

a casing having a top and a bottom and opposite ends and lateral sides extending between said ends, and a cylindrical recess extending into said housing from the top thereof and having an inner bottom;

a inner contact in said recess extending upwardly from the center of the inner bottom for engagement by a corresponding inner socket of a mating connector;

a conductor attached to the lower end of said inner contact and extending to and having a portion extending along the bottom of said casing to one end thereof;

a partially cylindrical outer contact on the wall of said recess and extending partly around the periphery of said recess for engagement by a corresponding outer conductor of a mating connector;

a further conductor attached to the lower end of said outer contact and extending to and having a portion extending along the bottom of said casing to the other end thereof; and a pair of fixing terminals on the bottom of said casing at the lateral sides thereof and electrically isolated from said conductors;

the bottom of said casing being divided into four quadrants with the point corresponding to the position of said inner contact as the origin point of the quadrants, said fixing terminals and said conductors each being in a different quadrant; and said substrate having on a surface thereof land portions at positions corresponding to the positions of the portions of said conductors extending along the bottom of said casing, said land portions being adapted to be connected to a microstrip line and a grounding pattern, respectively, and said substrate having further land portions on said surface at positions corresponding to the positions of said fixing terminals, said portions of said conductors and said fixing terminals being soldered to said land portions and said further land portions, respectively for mounting said plug connector stably on the substrate.

6. A plug connector as claimed in claim 5 in which said conductor attached to the lower end of said inner contact, said further conductor attached to the lower end of said outer contact, and said pair of fixing terminals all project slightly below the bottom of surface of the casing.

7. An electrical connector structure comprising, in combination:

a plug connector for mounting on a substrate, having:

a casing having a top and a bottom and opposite ends and lateral sides extending between said ends, and a cylindrical recess extending into said housing from the top thereof and having an inner bottom;

an inner contact in said recess extending upwardly from the center of the inner bottom for engagement by a corresponding inner socket of a mating connector;

a conductor attached to the lower end of said inner contact and extending to and along the bottom surface of said casing to one end thereof;

a partially cylindrical outer contact on the wall of said recess and extending partly around the periphery of said recess for engagement by a corresponding outer conductor of a mating connector;

a further conductor attached to the lower end of said outer contact and extending to and along the bottom of said casing to one end thereof; and a mating connector for said plug connector having:

a cylindrical outer contact having axial slits therein and resiliently engageable within said recess of said plug connector for resiliently electrically contacting said outer contact; and a central resilient sleeve contact within said cylindrical outer contact resiliently engageable over said inner contact of said plug connector, and electrically insulated from said cylindrical outer contact.

8. An electrical connector structure comprising, in combination:

a plug connector for mounting on a substrate, having:

a casing having a top and a bottom and opposite ends and lateral sides extending between said ends, and a cylindrical recess extending into said housing from the top thereof and having an inner bottom;

an inner contact in said recess extending upwardly from the center of the inner bottom for engagement by a corresponding inner socket of a mating connector;

a conductor attached to the lower end of said inner contact and extending laterally within the material of the bottom of the casing and then to and along the bottom surface of said casing flush therewith to one end thereof and then outwardly of said casing;

a partially cylindrical outer contact on the wall of said recess and extending partly around the periphery of said recess for engagement by a corresponding outer conductor of a mating connector;

a further conductor attached to the lower end of said outer contact and extending laterally outwardly to the outside of said casing and then toward the bottom of said casing and then projecting laterally of said casing slightly above the bottom surface of the casing, whereby the bottom surface of said plug connector has no projections and can be mounted flush on a substrate; and a mating connector for said plug connector having:

a cylindrical outer contact having axial slits therein and resiliently engageable within said recess of said plug connector for resiliently electrically contacting said outer contact; and a central resilient sleeve contact within said cylindrical outer contact resiliently engagable over said inner contact of said plug connector, and electrically insulated from said cylindrical outer contact.

9. An electrical connector structure as claimed in claim 8 in which said inner contact is cylindrical, and said conductor attached thereto being a flat conductor extending around the base thereof in an annular shape and having the part on one side of said inner contact cut along a chord, and having the part of the conductor extending within the material of the bottom of said casing extending from the opposite side of said inner contact from said chord and having a width equal to the length of the chord, and the part of said conductor extending to and along the bottom of the casing having a width greater than the length of the chord, whereby the impedance of the parts of the length of the conductor can be matched.

* * * * *